United States Patent [19]

Suzuki et al.

[11] 4,362,480

[45] Dec. 7, 1982

[54] ROTARY ROLLER VANE PUMP MADE OF SPECIFIC MATERIALS

[75] Inventors: Ryozo Suzuki; Sadatoshi Murakami; Tatsumi Harada; Hiroyuki Fujiwara; Satoru Yamasaki, all of Fukuyama, Japan

[73] Assignee: Mitsubishi Denki Kabushiki Kaisha, Tokyo, Japan

[21] Appl. No.: 136,316

[22] Filed: Apr. 1, 1980

[51] Int. Cl.[3] ..... F04C 2/00; F04C 15/00

[52] U.S. Cl. ..... 418/152; 418/178; 418/179; 418/225

[58] Field of Search ..... 418/152, 178, 179, 225

[56] References Cited

U.S. PATENT DOCUMENTS

| | | | |
|---|---|---|---|
| 2,126,200 | 8/1938 | Linderman | 418/178 |
| 3,096,569 | 7/1963 | Cook et al. | 418/152 |
| 3,419,208 | 12/1968 | Brewer et al. | 418/152 |
| 3,552,895 | 1/1971 | Bayley | 418/178 |
| 3,878,880 | 4/1975 | Jones | 418/178 |
| 3,892,028 | 7/1975 | Dobler | 418/178 |
| 4,086,043 | 4/1978 | Howe | 418/178 |
| 4,209,286 | 6/1980 | Schwartz | 418/152 |

FOREIGN PATENT DOCUMENTS

| | | | |
|---|---|---|---|
| 53-27108 | 3/1978 | Japan . | |
| 1324443 | 7/1973 | United Kingdom | 418/152 |

*Primary Examiner*—John J. Vrablik

*Attorney, Agent, or Firm*—Oblon, Fisher, Spivak, McClelland & Maier

[57] ABSTRACT

A rotary positive displacement pump of the pin roller type comprising a pump housing made of aluminum having a pump chamber with the inner periphery being cylindrical, which is fixed between a pump base and a pump case, a rotor eccentrically located within the pump chamber and driven by a motor, a plurality of rollers made of synthetic resin which is inserted in clearance grooves formed on the outer periphery of the rotor, wherein a centrifugal force generated when the rotor rotates moves the rollers toward the inner wall of the pump housing thereby to form a pump operation space.

1 Claim, 4 Drawing Figures

FIG. 1 PRIOR ART
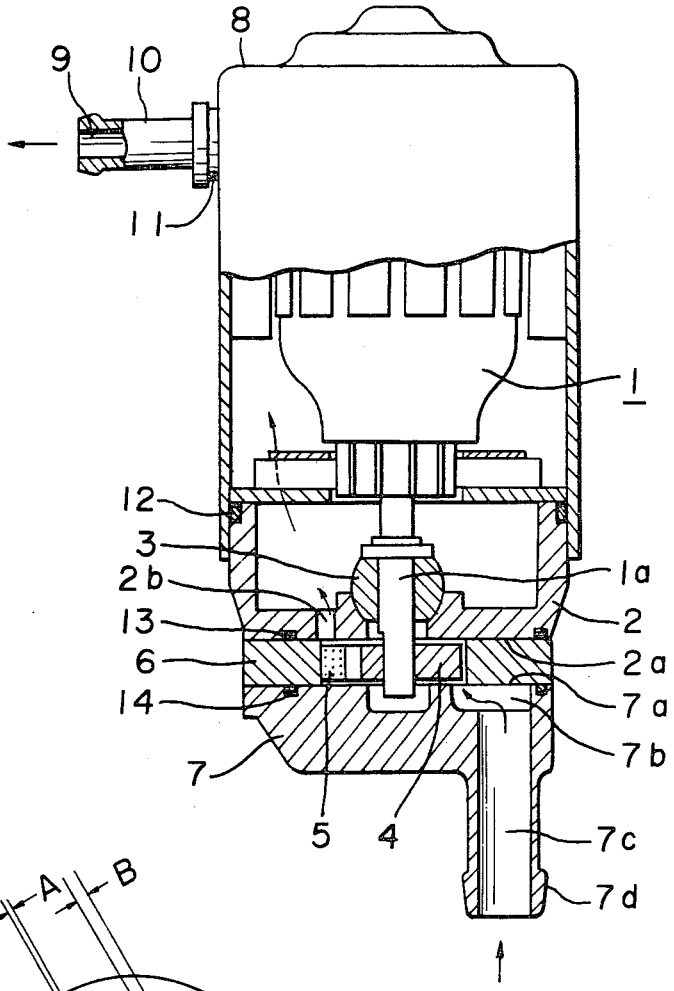
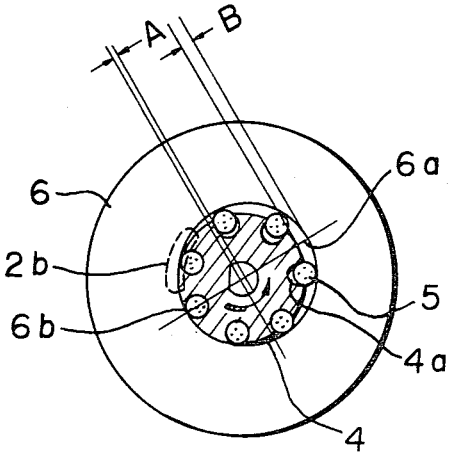
FIG. 2 PRIOR ART

ROTARY ROLLER VANE PUMP MADE OF SPECIFIC MATERIALS

BACKGROUND OF THE INVENTION

The present invention relates to a relatively small rotary liquid pump intended for use as an automobile fuel pump, particulary to a rotary positive displacement pump of pin roller type (hereinafter referred to as a vane pump).

A conventional vane pump of this kind is shown in FIG. 1. In the figure, reference numeral (1) is the armature of a motor to drive the pump, (1*a*) is the driving shaft of the motor (1), and (2) is a pump base made of a bowl with a wall (2*a*) to serve as the flat surface of the pump chamber, a guide hole (2*b*) to serve as a delivery outlet, and a bearing (3) embedded in pump base to support the driving shaft (1*a*). Reference numeral (4) denotes a rotor firmly mounted on the driving shaft (1*a*) and provided with a plurality of clearance grooves (4*a*) equally spaced and opened to the periphery thereof. (5) denotes free moving rollers each of which is inserted into the clearance grooves (4*a*) of the rotor (4). (6) denotes the pump housing to form the cylindrical side wall of the pump chamber. The rotor (4) and the rollers (5) are so placed in the pump housing (6) as to permit them to rotate freely therein. The center of the inner diameter of the pump hosing (6) is eccentrically positioned a certain distance (A) off the center of the driving shaft (1*a*) as shown in FIG. 2. The radius of the inner diameter of the pump housing (6) is slightly larger than the sum of the distance (A) and the radius (R) of the rotor (4), i.e. $A+R+\alpha$. The pump chamber formed is such that the rotor (4) comes closest to the inner cylindrical wall of the pump housing at the point (6*b*) of the wall and it is separated by a gap of $2(A+\alpha)=B$ at the point (6*a*) of the inner cylindrical wall. (7) is a pump case comprising a wall (7*a*) to provide a flat surface, an inlet groove (7*b*) for suction, and a hose joint (7*d*) with a clearance hole (7*c*) communicating with the inlet groove (7*b*) to surve as an intake. (8) is a metallic cylinder to accommodate the pump system therein and fitted with an exit pipe (10) via a packing (11). The exit pipe (10) has the outlet (9) at the other end. (12), (13), (14) are O-rings for hermetic sealing.

The following are the details of the construction and materials of the components to form the pump chamber. The pump base (2) and the pump case (7) are fabricated by die casting of aluminum die casting alloy. The walls (2*a*) and (7*a*) to provide flat surfaces are given surface treatment (anodizing) to form a film with abrasion resistance thereon after their machining finish. The rotor (4) and rollers (5) are fabricated by machining a piece of carbon steel to a shape close to the one shown in the drawing, quenching it to increase its wearing resistance, and grinding it for surface finishing. The pump housing (6) is fabricated by punching a sheet of carbon steel to form, quenching it to increase its wearing resistance, and grinding its inner cylindrical wall and both end surfaces.

The operation of the vane pump thus constructed will be described. When an electric power is fed to the armature (1) of the motor, the rotor (4) firmly mounted on its driving shaft (1*a*) rotates counterclockwise with the rotation of the shaft (1*a*). As the rotor (4) rotates, the rollers (5) fitted in the clearance grooves (4*a*) are forced to rotate counterclockwise by centrifugal force while they are kept in contact with the inner cylindrical wall of the pump housing (6). The description of the changes in the situation of the rollers (5) in the pump chamber as the rotor (4) rotates will be given in detail. A space of the pump chamber defined by one of the rollers (5) located at the point (6*b*) on the inner cylindrical wall at the start of pump operation will gradually increase as the rotor rotates thereby to have a negative pressure therein.

Consequently, fuel will be sucked through the clearance hole (7*c*) as the intake connected to the inlet groove (7*b*). When the rotor (4) moves further and passes the point (6*a*) on the inner cylindrical wall, the space in the pump chamber starts to decrease thereby gradually compressing the fuel. With the compression, the fuel reaches the duct (2*b*) for delivery outlet, moves forward inside the metallic cylinder and is delivered through the outlet (9). In this way, the well-known pumping operation is performed.

In the conventional vane pump thus constructed, when the rotor (4) and rollers (5) rotate, the both ends of the rotor (4) come in contact with the flat surface wall (2*a*) of the pump base (2) and the flat surface wall (7*a*) of the pump case (7), respectively, at the same time, the clearance grooves (4*a*) keep in contact with the outside of the rollers (5). The rollers (5), while in contact with the walls of the clearance grooves (4*a*), contacts at the outer wall with the cylindrical wall of the pump housing (6). Both ends of the rollers (5), like those of the rotor (4), comes in contact with the flat surface walls (2*a*) and (7*a*). Therefore, the known vane pumps tend to have the contact surfaces of their components worn out as a result of the contact friction between the parts of the pump components. This tendency becomes remarkable when a pump is operated in a dry condition for many hours or after use over a long period of time. The abrasion leads to an increase of current a reduction in rotational speed, and a decrease in internal pressure and quantity delivered. This will eventually bring about a failure of the fuel supply to an internal combustion engine. However, the conventional vane pumps as described above in regard to the components have all of the rotor (4), rollers (5) and pump housing (6) precision machined such as grinding machined after quenching for increased abrasion resistance. Therefore, it has disadvantages including a high cost due to the difficult machining and the heavy weight. The vane pump base (2) and the vane pump case (7) are also machined to produce the flat surface walls (2*a*) and (7*a*) after die casting. This is another disadvantage contributing to the high cost.

SUMMARY OF THE INVENTION

Accordingly, an object of the present invention is to provide a rotary positive displacement pump which is free from galling even after it continuously operates in a dry condition for several hours.

Another object of the invention is to provide a compact, lightweight rotary positive displacement pump with great durability due to good abrasion resistance that can be fabricated easily and is less costly.

Other objects and features of the invention will be apparent from the following description taken in connection with the accompanying drawings, in which:

BRIEF DESCRIPTION OF THE DRAWINGS

FIG. 1 is a longitudinal sectional view of a part of a conventional rotary positive displacement pump;

FIG. 2 is a cross sectional view of a substantial part of the pump shown in FIG. 1;

DETAILED DESCRIPTION OF THE PREFERRED EMBODIMENT

Figure 3:
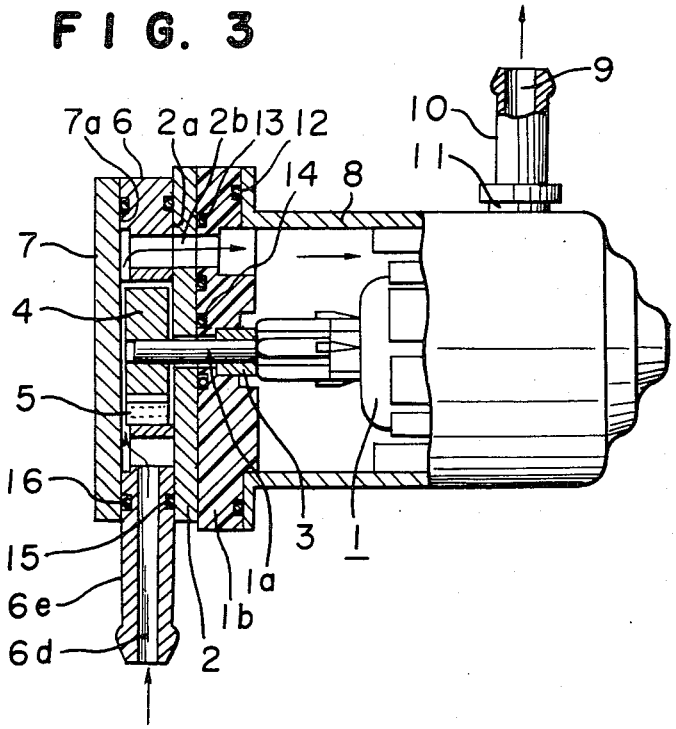
FIG. 3 is a longitudinal sectional view of a part of a rotary positive displacement pump according to the invention.
Figure 4:
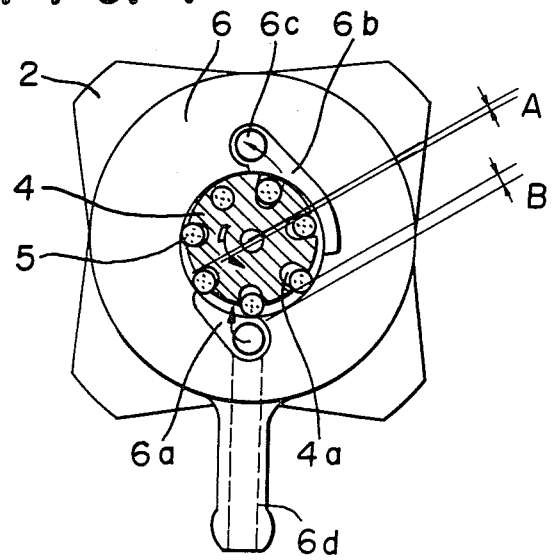
FIG. 4 is a cross sectional view of a substantial part of the pump shown in FIG. 3.

A preferred embodiment of the present invention will be described with reference to the drawings. In FIGS. 3 and 4, (1) is the armature of a motor to drive a pump, (1*a*) is the drawing shaft of the armature (1), (1*b*) is a bracket on which the brushes (not shown) to supply electric power to the motor and the like are mounted and in which a bearing (3) to support the driving shaft (1*a*) is embedded. (2) denotes a pump base an end of which forms a flat surface wall (2*a*) of the pump chamber. The pump base (2) has a guide hole (2*b*) to serve as an outlet. (4) is a rotor which is firmly mounted on the driving shaft (1*a*), provided with a plurality of clearance grooves (4*a*) equally spaced and opened to the periphery thereof. (5) denotes free moving rollers each of which is inserted into the clearance groove (4*a*) of the rotor (4). (6) denotes the pump housing to form the cylindrical side wall of the pump chamber. The rotor (4) and the rollers (5) are so placed in the pump housing (6) as to permit them to rotate freely therein. As shown in FIG. 4, the center of the inner diameter of the pump housing (6) is eccentrically located a distance (A) off the center of the driving shaft (1*a*) as shown in FIG. 4. The radius of the inner diameter of the pumping housing (6) is slightly larger than the sum of the radius (R) of the rotor (4) and the distance (A) between the center of the driving shaft (1*a*) and the center of the pump housing (6), i.e. $A+R+\alpha$. The pump housing (6) comprises a gate hollow (6*a*) for suction, a gate hollow (6*b*) for delivery, a guide hole (6*c*) for delivery and a hose joint (6*e*) with a through-hole (6*d*) as a inlet communicating with the gate hollow (6*a*) for suction. (7) denotes a pump case with the flat surface wall (7*a*). (8) denotes a metallic cylindrical case to accommodate the pump system. An exit pipe (10) with an outlet (9) is fastened to the metallic cylindrical case (8) via a packing (11), (12), (13), (14), (15) and (16) are O-rings for hermetic sealing. The detailed description on the constructions and materials of the components to form the pump chamber will follow. The bracket (1*b*) is made of plastic (e.g. polyacetal resin). The pump base (2) and the pump case (7) are fabricated by blanking a piece of aluminum plate and treating it to provide Teflon impregnated hard porous oxide film on its surface (which has excellent abrasion resistance and corrosion resistance and low friction coefficient). The rotor (4) is fabricated by die casting zinc alloy for die casting, machining the casting and giving copper or nickel plating on its surface.

The rollers (5) are preferably made of polyphenylenesulfide which has excellent heat resistance, rigidity, flameproofing and chemical resistance. The polyphenylenesulfide is usually reinforced by incorporating carbon fiber or glass fiber, if necessary with fluorine component or molybdenum component. The synthetic resin composition containing a reinforcing filler is usually used for preparing the rollers (5) by an injection molding. The pump housing (6) is preferably made of a die cast aluminum alloy which can be coated with polytetrafluoroethylene. The die casted aluminum alloy is preferably coated with polytetrafluoroethylene after a surface treatment by machining, whereby the abrasion resistance of the inner wall is improved. Although this preferred embodiment uses the pump housing (6) entirely made of aluminum die casting, it is also possible to use an aluminum plate which has been pressed into an appropriate form or cold rolled into such a form and treated to coat polytetrafluoroethylene. Further, an annular piece coated with polytetrafluoroethylene on its inner surface may be fitted to the cylindrical pump housing (6).

In selecting the combination of the above-mentioned materials, the requirements to be met include the absence of abrasion, seizing or the like between components as a result of rotational friction in addition to precision tolerances, surface roughness limit, abrasion resistance, high speed rotation, resistance to gasoline, resistance to dry rotation, high and low temperature resistance, corrosion resistance and the like. Even a single piece of components in the combination could lead to abrasion or seizing if it loses its balance with the others (because of faulty material or surface treatment), and cause the pump performance to degrade, eventually bringing it to a halt. In consideration of these requirements, the above-mentioned materials have been selected through a total of 30 fundamental abrasion resistance tests, 15 different treatment tests of materials, 12 different treatment tests with respective components, and some 15 different combination tests as well as 8 different durability tests with the practical machine in which the test pump was incorporated. The tests confirmed that the selected combination satisfies the required durability of 4000 hours in gasoline. The durability is good enough to meet the requirement for durability imposed on the fuel pump for an automobile.

Since the vane pump constructed as described above operates in the same way as the conventional pump mentioned above, the description thereof will be omitted. It should be noted that the vane pump of the present invention has an excellent capability of being fabricated more simply and less costly, and lighter in weight than some conventional pumps of which the pump base (2) and pump case (7) are made of aluminum die casting, because those of the present invention are made of punched and formed aluminum plates. Since the rotor (4) of the present invention is made of zinc die casting alloy, it does not need quenching and precision machining such as grinding unlike conventional one needs them for the rotor. This also contributes to making the fabrication simpler and less costly. The use of PPS material to form the rollers (5) makes it unnecessary to quench the material and machine it precisely by such means as grinding unlike the conventional one, this making it possible to fabricate them more simply and less costly. Also the reduction in their weight alleviates the jarring noise from the revolution of the rollers (5) in contact with the cylindrical wall of the pump housing (6) under the influence of centrifugal force, the noise from the rollers (5) rotating in the clearance grooves (4*a*) of the rotor (4) and the noise generated by the contact between the flat surface wall (2*a*) of the pump base (2) and the flat surface wall (7*a*) of the pump case (7). Due to the self-lubricating characteristic of the material, the abrasion of the rollers (5) and that of the components in contact with them are reduced. This is another feature of the present invention. The PPS material has excellent abrasion resistance and resistance against oil and chemicals. The thermal expansion coefficient is as small as those of aluminum alloys and zinc alloys, so that there are substantially no problems in having the rollers (5) expand longitudinally against the flat surface walls (2*a*) and (7*a*) of the pump base (2) and pump case (7) that may embrace the rollers (5) at higher temperatures and in having the rollers (5) shrink at lower temperatures leaving a large enough clearance to cause insufficient suction. The use of aluminum alloy die casting to form the pump housing (6) makes it possible to fabricate the pump housing more simply and less costly and reduce its weight because it eliminates the need for quenching the material and machining it precisely, although the conventional way has such need.

Furthermore, the use of quenched carbon steel for all of the rotor (4), rollers (5) and pump housing (6) in the case of the conventional pumps makes it likely that they may seize with each other as a result of continuous operation in a dry condition for several hours and would then show accelerated abrasion. On the other hand, the present invention utilizes nickel plated zinc alloy material for the rotor (4), the PPS material for the rollers (5), and aluminum material treated to provide Teflon impregnated hard porous oxide film on its surface for the pump housing (6), pump base (2) and pump case (7), in combination for pump fabrication. Therefore, there is no contact area between components of the same material and the same hardness. For this reason, the present invention provides excellent abrasion resistance. The design of the vane pump that has been described above is able to provide compact lightweight vane pumps with great durability due to good abrasion resistance that can be fabricated easily and less costly. Although the foregoing preferred embodiment refers to a roller vane type pump, the present invention may be as effective for vane pumps with other types of vanes than the roller type.

We claim:

1. A rotary positive displacement pump driven by a motor and comprising:

a pump base;

a pump case;

a pump housing hermetically sealed with and disposed between said pump base and said pump case and forming a pump chamber with a cylindrical side wall;

a die casted, abrasion resistance treated, zinc alloy rotor placed in said pump housing to be driven by said motor and having a plurality of grooves formed therein at the outer radial surface thereof;

a plurality of rollers each of which is inserted into one of said plurality of grooves so as to move in the radial direction under circumferential force by the revolution of said rotor so as to contact with an inner wall of said pump housing to thereby provide a pump operating space;

intake means which further comprises means for hermetically sealing said intake port means between said pump base and said pump case and for communicating with said pump chamber wherein said rollers further comprise; fiber reinforced polyphenylenesulfide and wherein at least said inner wall of said pump housing further comprises polytetrafluoroethylene coated aluminum alloy;

wherein said abrasion resistance treated rotor further comprises one of a copper and nickel plated rotor; and wherein said fiber reinforced polyphenylenesulfide rollers further comprises one of carbon and glass fiber reinforced polyphenylenesulfide rollers.

* * * * *